US008701780B2

(12) United States Patent
Morton

(10) Patent No.: US 8,701,780 B2
(45) Date of Patent: Apr. 22, 2014

(54) HYDRAULICALLY DRIVEN, DOWN-HOLE JET PUMP

(76) Inventor: Scott A. Morton, Laramie, WY (US)

( * ) Notice: Subject to any disclaimer, the term of this patent is extended or adjusted under 35 U.S.C. 154(b) by 317 days.

(21) Appl. No.: 13/245,508

(22) Filed: Sep. 26, 2011

(65) Prior Publication Data

US 2013/0075105 A1 Mar. 28, 2013

(51) Int. Cl.
*E21B 43/00* (2006.01)

(52) U.S. Cl.
USPC ..... 166/369; 166/373; 166/105; 166/325; 417/151

(58) Field of Classification Search
USPC ..... 166/369, 373, 105, 325, 68.5, 74; 417/151
See application file for complete search history.

(56) References Cited

U.S. PATENT DOCUMENTS 4,202,656 A * 5/1980 Roeder ..... 417/88
4,518,036 A * 5/1985 Lefebvre et al. ..... 166/105
4,790,376 A 12/1988 Weeks
5,083,609 A * 1/1992 Coleman ..... 166/68
5,372,190 A * 12/1994 Coleman ..... 166/68
6,076,557 A 6/2000 Carney
6,644,354 B2 11/2003 Dinkel et al.
7,188,687 B2 3/2007 Rudd et al.
7,241,382 B2 7/2007 Gordon
7,665,527 B2 2/2010 Loretz
7,775,776 B2 8/2010 Bolding
2010/0192563 A1 8/2010 Rose et al.

OTHER PUBLICATIONS

International Search Report, International Searching Authority, Dec. 11, 2012, pp. 1-16.
Karassik, Igor J. et al., Pump Handbook, Fourth Edition; McGraw-Hill; New York; 2008, pp. 7.9-7.15.

* cited by examiner

*Primary Examiner* — Yong-Suk (Philip) Ro
(74) *Attorney, Agent, or Firm* — Samuel M. Freund; Cochran Freund & Young LLC

(57) ABSTRACT

A down-hole jet pumping apparatus and method for removing accumulated water in a small diameter well bore are described. Chosen fluids are pumped under high pressure from a surface pump through a 3-way valve into a tube disposed in a well bore. The jet pumping apparatus includes a down-hole accumulator connected to an eductor. The high-pressure fluid is stored in the accumulator and may be released to the surface reservoir by the control valve through the tube along with the fluid to be pumped drawn into the eductor. When the accumulator is exhausted, the control valve again directs high-pressure fluid from the surface pump to the accumulator until a chosen pressure is achieved in the accumulator. The fluid pressure in the accumulator is maintained using a gas-charged metal bellows. Hydraulically driven jet boosters are described for increasing the fluid pressure along the tube in deep wells.

20 Claims, 9 Drawing Sheets

HYDRAULICALLY DRIVEN, DOWN-HOLE JET PUMP

FIELD OF THE INVENTION

The present invention relates generally to removing fluids from wells and, more particularly, to the use of a hydraulically driven down-hole jet pumping apparatus for remove fluids from a well bore.

BACKGROUND OF THE INVENTION

Often fluids need to be removed from wells, either to recover a useful fluid such as oil or water or to remove an unwanted fluid such as water in a gas well. Of particular difficulty is the removal of produced water from a gas well when the formation pressure begins to decrease and the well begins to produce increasing quantities of water. At some point a water column will form in the well and block the flow of gas. The water must then be removed to restore gas flow. Foaming agents may be injected into the well to reduce the water density and assist the gas flow in carrying the foam, and hence the water, out of the well. However, if the gas flow has ceased, the water must be removed to restart the gas flow.

Gas wells are typically deep wells, in the range of 8,000 feet to 20,000 feet deep, and often have small diameters, of the order of four-inch casings having inside diameters of about three inches. These characteristics make it difficult to remove water using conventional pumping systems. Water is commonly lifted from such wells using large volumes of nitrogen gas to carry water droplets out of the well, and preventative measures, such as foaming agent injection, are used to retard shutoff of the gas flow by the water. However, production time is lost whenever a nitrogen lift procedure is done, since the well must be flared for a period of time to reduce the nitrogen concentrations to insignificant levels. Typical costs for a nitrogen lift operation are approximately $20,000 for a single nitrogen lift operation, $20 per day for injection of a foaming agent, and $7,000 for lost production for a 350 mcf per day well. Further, a nitrogen lift might be required every 1 to 2 months for a well that is producing 20 to 40 gallons of water per day. Total costs for maintaining gas well production may exceed $150,000 annually. As stated, small well bores make the use of conventional plunger pumps and electric motor driven pumps to remove the water difficult, if not impossible. Jet pumps can be and are being used, but these pumps require dual, concentric tubing systems. Dual, concentric tubing is considerably more expensive than single tubing. It has a larger diameter, which restricts the well bore, as well as requiring more complex and expensive equipment for installation and operation than would be required for use of a single tube.

SUMMARY OF THE INVENTION

Accordingly, it is an object of embodiments of the present invention to provide an apparatus and method for removing fluids from well bores.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects, and in accordance with the purposes of the present invention, as embodied and broadly described herein, the hydraulically driven jet pumping system for removing fluids from a well bore, hereof, includes: a surface pump for pumping a chosen fluid; a tube disposed in the well bore; a jet-pumping apparatus disposed in the well bore below perforations therein which permit fluid flow between a surrounding formation and the well bore, including: an eductor in fluid communication with the tube and with the fluid flow from the perforations in the well bore; an inlet check valve for permitting fluid in the well bore to flow into the eductor; and an accumulator comprising a pressure vessel and a gas-charged metal bellows disposed therein, the accumulator being in fluid communication with the eductor; and a 3-way valve in fluid communication with the surface pump and the tube, for exhausting fluids exiting the tube, and for providing fluid communication between the surface pump and tube.

In another aspect of the invention, and in accordance with its objects and purposes, the method for removing fluids from a well bore, hereof, includes: pumping a chosen fluid from the surface through a tube in the well bore through an eductor disposed in the well bore below the perforations in the well bore and in communication with fluids in the well bore to be removed, and into an accumulator disposed in the well bore until a first selected pressure is obtained; compressing a gas-charged metal bellows in the accumulator; and releasing the pressure on the tube at the surface such that the chosen fluid is forced through the eductor and through the tube to the surface, whereby fluids in the well bore to be removed are drawn into the eductor and flow into the tube to the surface.

Benefits and advantages of the present invention include, but are not limited to, providing an apparatus and method for removing fluids from a well bore through a single tube using a compact and efficient metal bellows driven eductor.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Briefly, the present invention includes a down-hole jet pumping apparatus suitable for use in a deep, small diameter well bore to remove accumulated water. Similar technology may be adapted to pump oil from oil wells or water from water wells and may be used on larger diameter wells.

Figure 1A:
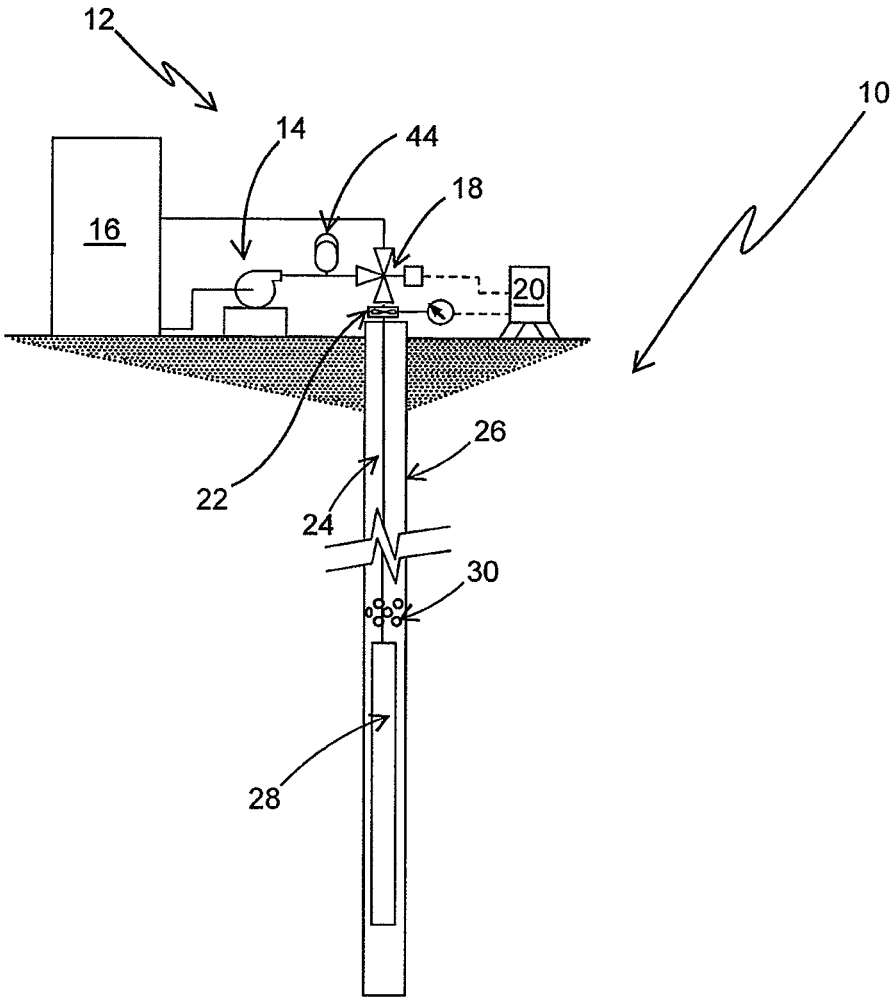
FIG. 1A is a schematic representation of a side view of an embodiment of the single-line, hydraulically driven, down-hole jet pump system of the present invention.

Reference will now be made in detail to the present embodiments of the invention, examples of which are illustrated in the accompanying drawings. In the FIGURES, similar or identical structure will be identified using the same reference characters. Turning first to FIG. 1A a schematic representation of a side view of an embodiment of single-line, down-hole jet pumping system, 10, of the present invention is illustrated. Surface pumping apparatus, 12, includes conventional high-pressure pump, 14, which pumps chosen fluids, for example, produced water from water reservoir or holding tank, 16, through 3-way valve, 18, actuated by control system, 20. Fluid measurement apparatus, 22, includes flowmeters and pressure transducers, as examples, and provides fluid measurements to control system 20. A source of power, not shown in FIG. 1A, is located at the ground surface near the well head. Single tube or pipe, 24, disposed in well bore, 26, provides fluid connection between surface pumping apparatus 12 and jet pumping apparatus, 28, situated in well bore 26 below perforations, 30, in well bore 26 which permits fluids outside of the well bore to flow into and out of the well bore.

Figure 1B:
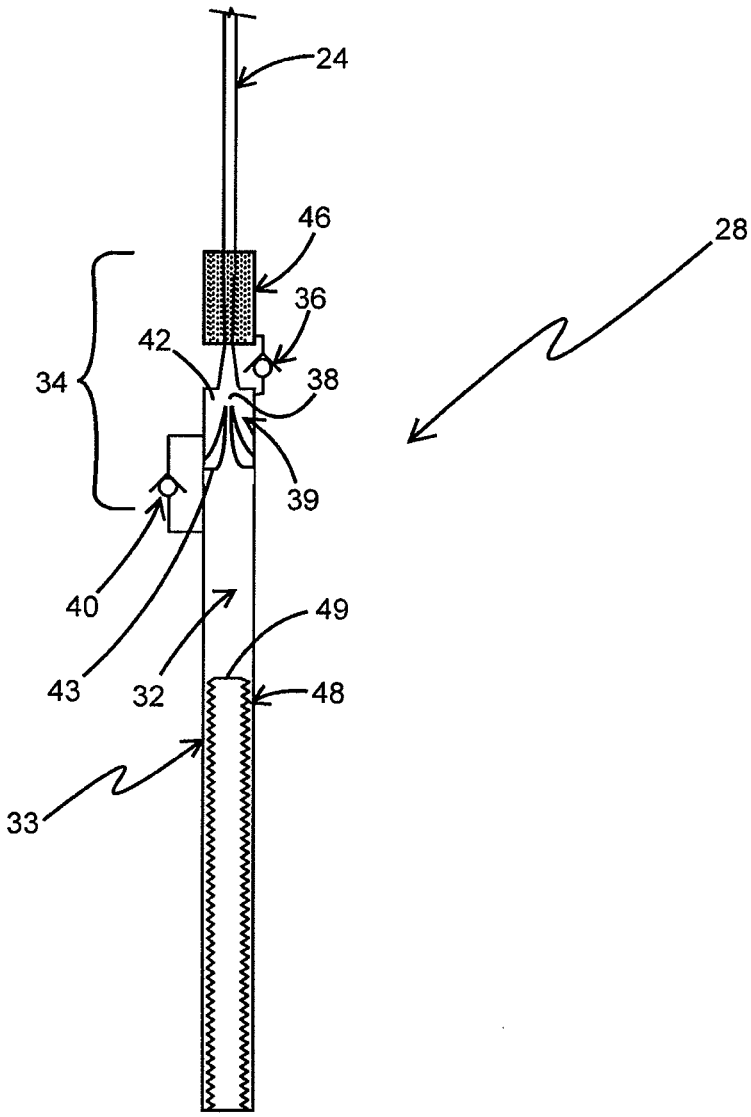
FIG. 1B is a schematic representation of a side view of an embodiment of the single-line, hydraulically driven, down-hole jet pumping apparatus of the present invention for use with the system illustrated in FIG. 1A hereof.

FIG. 1B is a schematic representation of a side view of an embodiment of single-line, hydraulically driven, down-hole jet pumping apparatus 28 of the present invention for use with the down-hole jet pumping system, 10, illustrated in FIG. 1A hereof. The jet pumping apparatus includes down-hole pressure vessel, 32, which is part of accumulator, 33, in fluid communication with eductor, 34, having inlet check valve, 36, for preventing fluid from flowing from eductor 34 into well bore 26 (FIG. 1A), while allowing fluid to flow from well bore 26 into eductor 34 through perforations 30. A hydraulic accumulator is an energy storage device using hydraulic fluid under pressure. High pressure fluid from surface pump 14 is directed through single tube 24 of jet pumping apparatus 28, and enters down-hole pressure vessel 32 though both eductor jet orifice, 38, in eductor jet, 39, and through quick fluid recharge bypass check valve, 40, described in detail hereinbelow, effective for bypassing eductor jet orifice 38 and creating a less-restrictive flow path into pressure vessel 32. This less restrictive flow path permits down-hole pressure vessel 32 to be recharged in a shorter period of time than relying solely on the flow through eductor jet orifice 38. Eductor jet orifice 38 may include a ruby or diamond orifice, and the fabrication of eductor mixing chamber, 42, from carbide material may reduce wear from erosion by the fluids. The end of eductor jet 39 opposite jet orifice 38 has sealing surface, 43, which will be discussed in more detail hereinbelow.

The fluid stored in down-hole pressure vessel 32 under pressure from surface pump 14 may be released to surface reservoir or holding tank 16 by 3-way control valve 18 at the surface through single tube 24 along with the additional fluid that is drawn into eductor 34. The combined fluids are discharged into surface holding tank 16 which is also the source of fluid for high-pressure surface pump 14. When the down-hole accumulator is exhausted, and flow ceases at the surface, 3-way control valve 18 again directs high pressure fluid from surface pump 14 to down-hole pressure vessel 32 until a chosen jet pump pressure is achieved in the down-hole accumulator. Surface accumulator, 44, (FIG. 1A) may reduce the power requirements of surface high pressure pump 14 by distributing the pumping effort over the entire cycle instead of only over the recharge part of the cycle.

Screen and filter system, 46, installed on the suction side of eductor 34 prevents debris and grit from the formation from entering the jet pumping apparatus with attendant wear and damage to the pump. Such screen and filter system may be disposed above jet pumping apparatus 28 and concentric with tube 24. Gas-charged, sealed metal bellows, 48, stores the pumping energy in down-hole pressure vessel 32, which, together with pressure vessel 32, comprise accumulator 33. The pre-charge gas pressure of metal bellows 48 may be adjusted prior to down-hole installation to optimize the jet pump operation for particular well depth and formation pressure conditions according to well-known jet pump performance calculations (See, e.g., Igor J. Karassik et al., *Pump Handbook*, Fourth Edition; McGraw-Hill; New York; 2008, pages 7.9 through 7.15).

The metal bellows is pre-charged with nitrogen or another gas. When fluid enters pressure vessel 32 in which the pre-charged metal bellows is situated, the bellows is compressed by the essentially incompressible liquid. As the pre-charge bellows compresses the internal volume decreases and the nitrogen gas pressure increases. The limit to this process is when the metal bellows "stack" becomes effectively a solid. When the charging pressure is reduced by releasing fluid in tube 24 through 3-way valve 18, the liquid in the pressure vessel exits the pressure vessel, and the metal bellows expands.

When a pumping cycle begins with stored energy being released from accumulator 33 of jet pump 28, initially a portion of the energy is expended in accelerating the water column in tube 24, and does not contribute to pumping effort. As the momentum of the water column is established, pumping action builds and continues after steady-state is achieved until accumulator 33 is exhausted. The energy expended in accelerating the water column can be at least partially recovered when the accumulator is exhausted with bellows 48 having expanded, if accumulator 33 has a shut off valve that actuates when the accumulator is empty or near empty. This type of valve currently exists in some accumulators and is often implemented by having the flexible member of the accumulator cover the outlet port. The result of the sudden stoppage of the motive fluid in the jet pump is that the momentum of the water column is dissipated not only through frictional losses but also by "pumping" more fluid against the pressure head for a short time. That is, there is a short surge in the pumped fluid entering the jet pump inlet since the discharge fluid is instantaneously moving at or close to the same velocity as prior to the exhaustion of the accumulator, whereas the motive fluid flow has dropped to zero. The quantity of fluid entering the pump inlet compensates for the lack of the motive fluid flow, and the surge then decays away as the momentum of the water column dissipates.

A second benefit of using an accumulator shut-off valve derives from the ability to shut off the accumulator with a residual pressure therein chosen to be higher than the pressure of the system outside the accumulator and close to the pre-charge pressure of the bellows. Such retention of pressure lowers the stresses on the flexible metal bellows of the accumulator with the result that the fatigue life and reliability of the flexible member is enhanced.

An implementation of the accumulator shutoff valve is illustrated in FIG. 1B hereof, wherein top surface, 49, of bellows 48 has a shape effective for sealing against sealing surface 43 of eductor jet 39, such that when the external pressure is reduced on bellows 48, to a chosen value, surface 49 thereof contacts sealing surface 43, thereby shutting the accumulator. Either jet nozzle sealing surface 43 or the top surface 49 of metal bellows 48 may include an elastomeric seal to improve the sealing characteristics of accumulator 33. The top of bellows may also be conical in shape to assist in guiding the top of the bellows into position. Other means for providing this function include fabricating the top of the bellows to be a cylinder having a circumferential sealing ring adapted for being received by a suitably sized cylindrical socket in the lower end of the entrance of the eductor jet nozzle 39 and sealing when the sealing ring enters the socket. The latter configuration may make the fluid shutoff more abrupt, more effectively taking advantage of the fluid momentum.

Figure 1C:
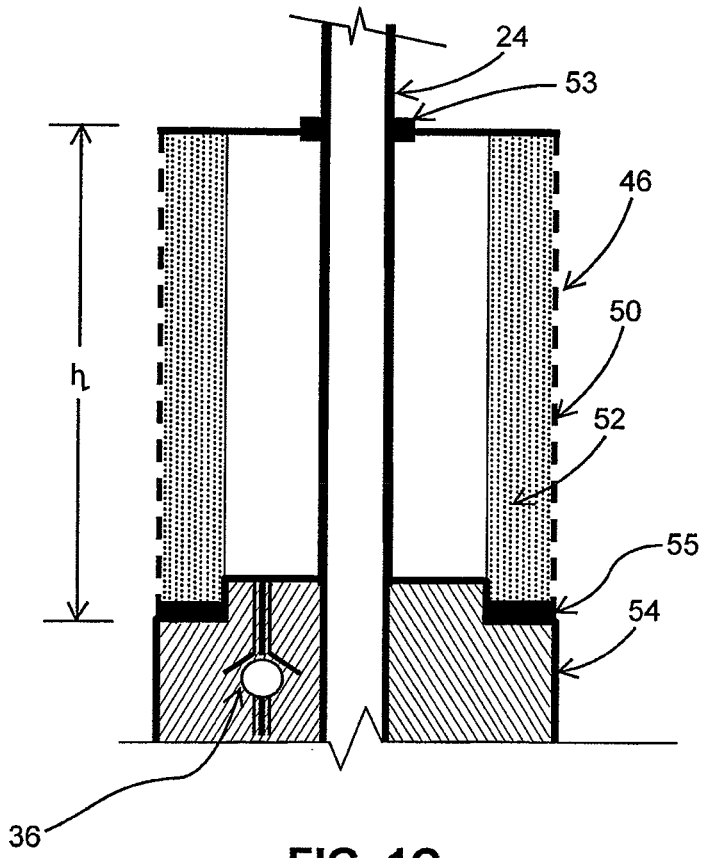
FIG. 1C is a schematic representation of the cross section of the concentric inlet screen and filter system shown in FIG. 1B hereof.

A schematic representation of a cross section of the screen and filter system illustrated in FIG. 1B is shown in FIG. 1C. Cylindrical screen, 50, and cylindrical filter, 52, of system 46 are shown. Since screen and filter system 46 is disposed concentrically with single tube 24 to the surface, the screen and filter system may be made as long as needed to achieve low fluid velocity through the filter, thereby minimizing pressure loss through the filter and prolonging the service life thereof. In an embodiment of down-hole pump apparatus 28, screen and filter assembly 46 may be sealed to pipe 24 by seal, 53, and mate and seal to body, 54, of jet pump apparatus 28 by seal, 55. Inlet check valve 36 may then be built into to the jet pump body. The chosen height of screen and filter system 46 is shown as the dimension, h, in FIG. 1C.

Figure 2:
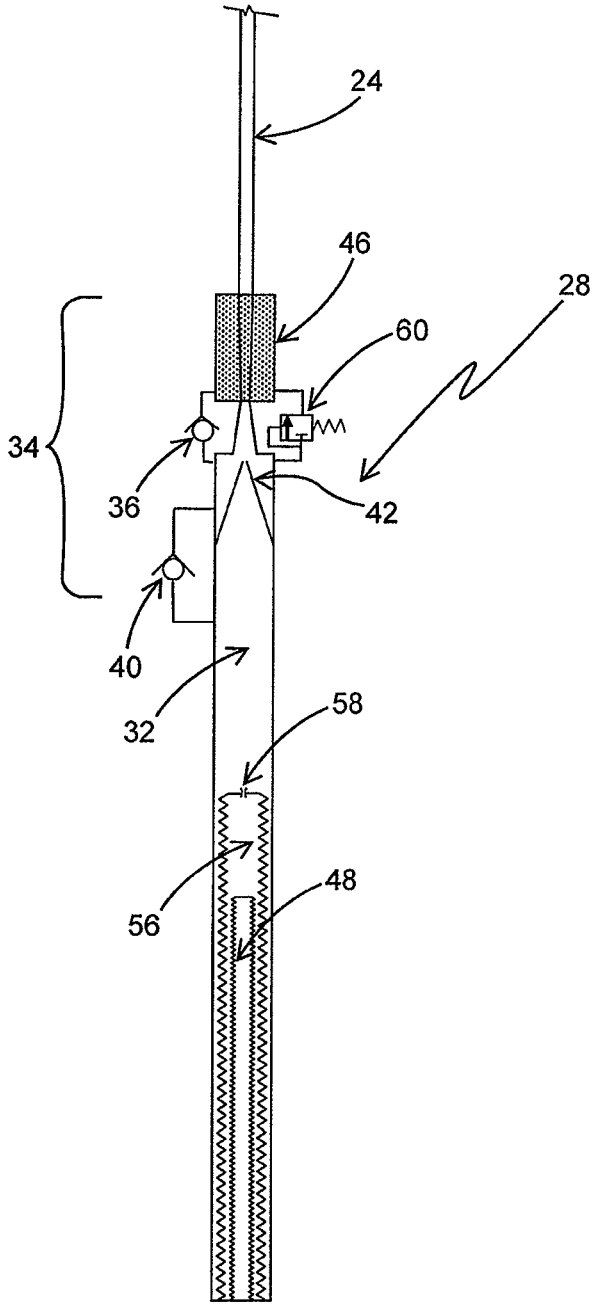
FIG. 2 is a schematic representation of the single-line, hydraulically driven, down-hole jet pumping unit shown in FIG. 1B hereof having a three-chamber accumulator, and a back flush relief valve.

FIG. 2 is a schematic representation of down-hole pumping apparatus 28 illustrating a three-chamber accumulator and a back flush relief valve. In-situ adjustment of the pre-charge pressure of bellows of down-hole accumulator 32 may be achieved using a three-chamber accumulator, where working fluid chamber 32 communicates to intermediate chamber, 56, through orifice, 58, that is sufficiently small that flow between the two chambers during a pumping cycle is not significant. Gas-charged third chamber 48 is contained within intermediate chamber 56. If tubing line 24 is held at elevated pressure for an extended time, fluid enters intermediate chamber 56 and compresses gas chamber 48, thereby increasing the pre-charge pressure. Conversely, if tubing line 24 is held at surface atmospheric pressure for an extended time, fluid will drain from intermediate chamber 56 and gas chamber 48 will expand. This action will decrease the pre-charge pressure.

Pressure relief valve, 60, is disposed in parallel fluid communication with inlet check valve 36, such that pressure relief valve 60 may discharge fluid from eductor 34 into screen and filter system 46, by elevating the tubing line pressure above the pressure relief valve setting, thereby permitting back flushing of the screen and filter system 46.

Figure 3A:
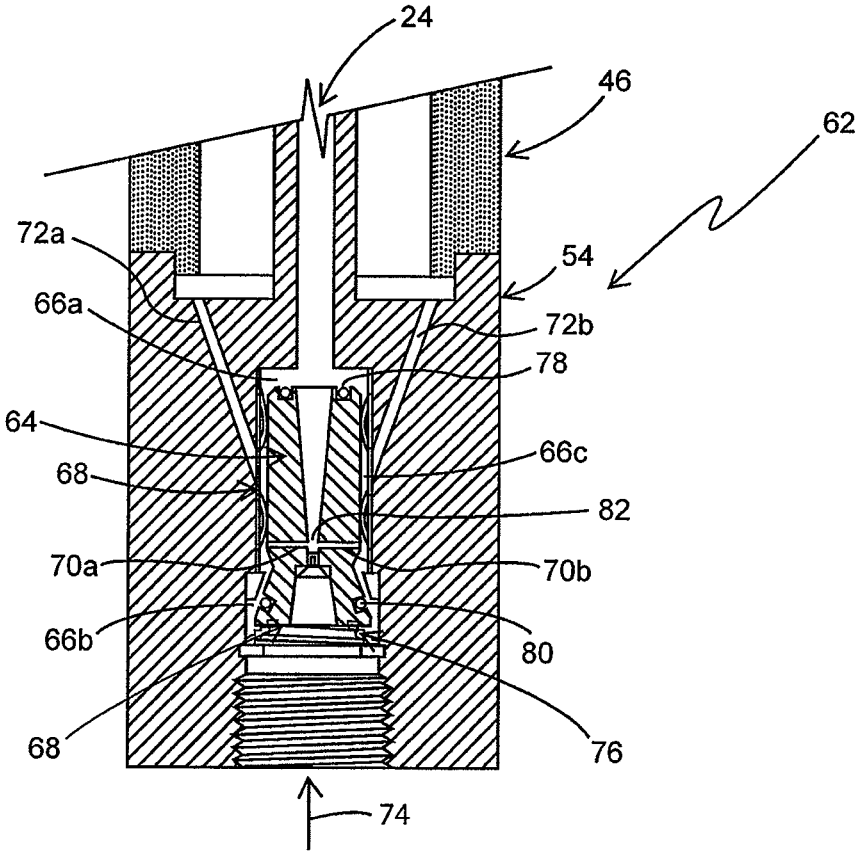
FIG. 3A is a schematic representation of a cross section of the single-line, hydraulically driven, down-hole jet pump shown in FIG. 1B hereof having a combined jet pump nozzle and rapid fluid recharge bypass check valve with the bypass check valve shown in its open configuration.

Since embodiments of the present invention are hydraulically driven, down-hole jet pumping systems are applicable to wells having small-diameter well bores. By combining jet pump nozzle 38 with quick fluid recharge bypass check valve 40 by embedding jet nozzle 38 in the movable closure element of check valve 40, provides a still more compact design. Turning now to FIG. 3A, a schematic representation of a cross section of an embodiment of combined jet pump apparatus nozzle and the fluid recharge bypass check valve, 62, is shown in its open condition. When charging pressure is applied through tube 24 to closure element, 64, of check valve 62, the closure element retracts to expose flow spaces, 66*a*, and, 66*b*, connected by space, 66*c*, between closure element 64 and body 54 of jet pump 28, and having significantly increased flow area. The pressure forcing closure element 64 downward also cause guide, 68, to expand, as will be described in more detail hereinbelow, thereby blocking fluid from flowing through flow spaces 66*a*, and, 66*b* and channels, 70*a*, and, 70*b*, in closure element 64, and into channels, 72*a*, and, 72*b*, of body 54 of jet pump 28.

Figure 3B:
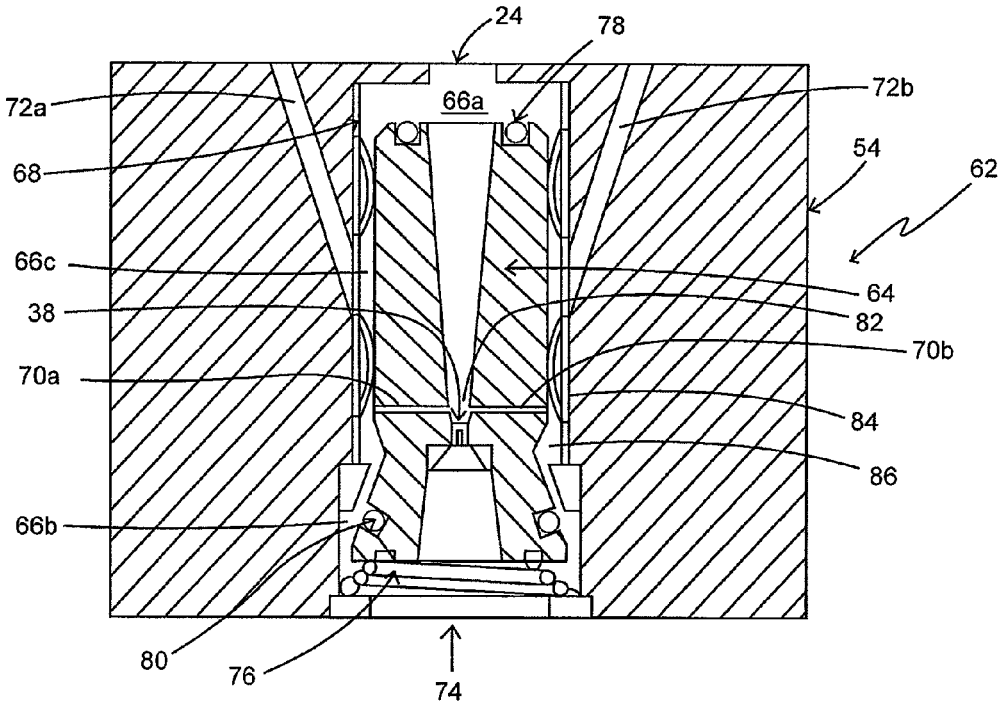
FIG. 3B is a schematic representation of an expanded view of a cross section of the recharge bypass check valve shown in FIG. 3A hereof showing the combination inlet check valve and closure element guide.

FIG. 3B is an expanded schematic representation of a cross section of the combined jet pump apparatus nozzle and the fluid recharge bypass check valve shown in FIG. 3A hereof.

Figure 3C:
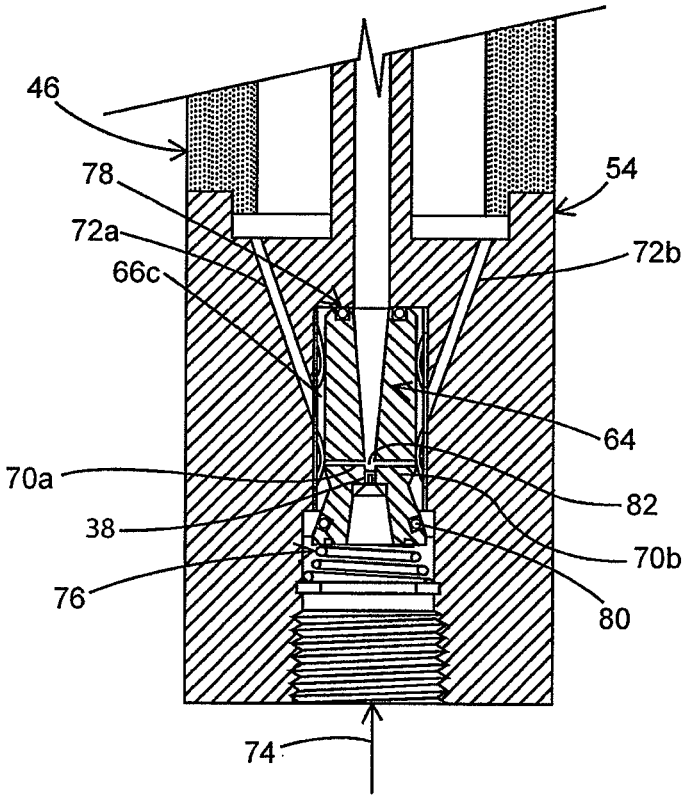
FIG. 3C is a schematic representation of a cross section of the single-line, hydraulically driven, down-hole jet pump shown in FIG. 1B hereof having a combined jet pump nozzle and rapid fluid recharge bypass check valve with the bypass check valve, shown in its closed configuration.

When the charging pressure is removed, accumulator fluid pressure, 74, and the force of return spring, 76, move closure element 64 to the closed position shown in FIG. 3C, wherein O-rings 78 and 80 prevent fluid from flowing through flow areas 66*a* and 66*b*, and the reduction in pressure in volume, 82, as a result of fluids 74 driven by accumulator 32 through nozzle 38 causes fluid to flow from the formation through screen and filter system 46 through channels 72*a* and 72*b* through space 66*c* and into channels 70*a* and 70*b* to volume 82, wherein the fluids are pumped out of the formation through single tube 24.

Figure 3D:
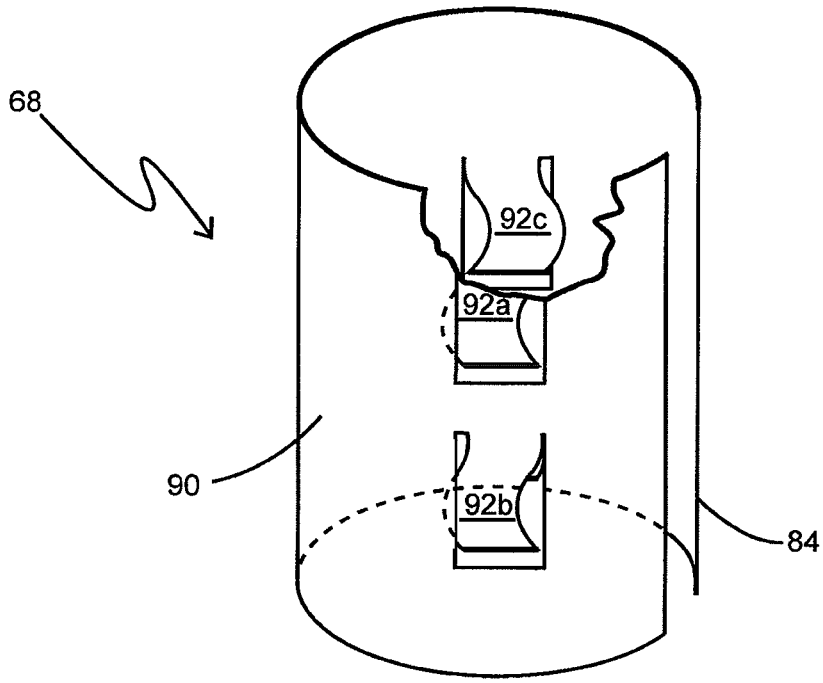
FIG. 3D is a schematic representation of a projection view of the expanded closure element guide shown in FIG. 3A hereof.

A schematic representation of a projection view of recharge check valve guide 68, is illustrated in FIG. 3D. Cylindrical, spring-steel guide 68 is longitudinally open along one side, so as to apply a light preload pressure to the cylindrical wall (shown as reference character, 84, of FIG. 3B hereof) of the bore (shown as reference character 86 in FIG. 3B hereof) of recharge check valve 62. Solid portions, 90, of guide 68 are disposed such that channels 72*a* and 72*b* from screen and filter system 46 are covered and blocked when recharge pressure is applied to the fluid recharge bypass check valve; that is, the solid wall portions 90 of the guide are then pressed more firmly against the channel orifices in the wall of the recharge check valve bore. Elastomeric seats. (not shown in FIG. 3C) may be incorporated into the ports of the channels 72*a* and 72*b* to assist in sealing these channels during recharging. However, as stated hereinabove, when the accumulator fluid 74 is released into check valve 62 and expanded through nozzle 38, suction is generated in volume 82, in channels 70*a* and 70*b*, and in volume 66*c*, such that wall 90 of guide 68 is released from wall 86 of bore 88 permitting fluid from screen and filter system 46 to enter bore 88 from channels 72*a* and 72*b*. Leaf springs shown as, 92*a*-92*c*, formed in the wall 90 of guide 68, stabilize closure element 64 and permit movement thereof in bore 88.

In wells deeper than about 8,000 feet deep, a single-stage jet-pumping apparatus may not be effective for pumping fluids to the surface. In such cases, one or more hydraulically driven jet-pump pressure boosters may be employed to provide additional fluid lift. The accumulator of the jet-pump pressure booster may be a relatively long, small diameter, concentric tubular design to permit the jet-pump apparatus dewatering tubing to pass through the booster, thereby minimizing blockage of the production tubing in the well.

Figure 4:
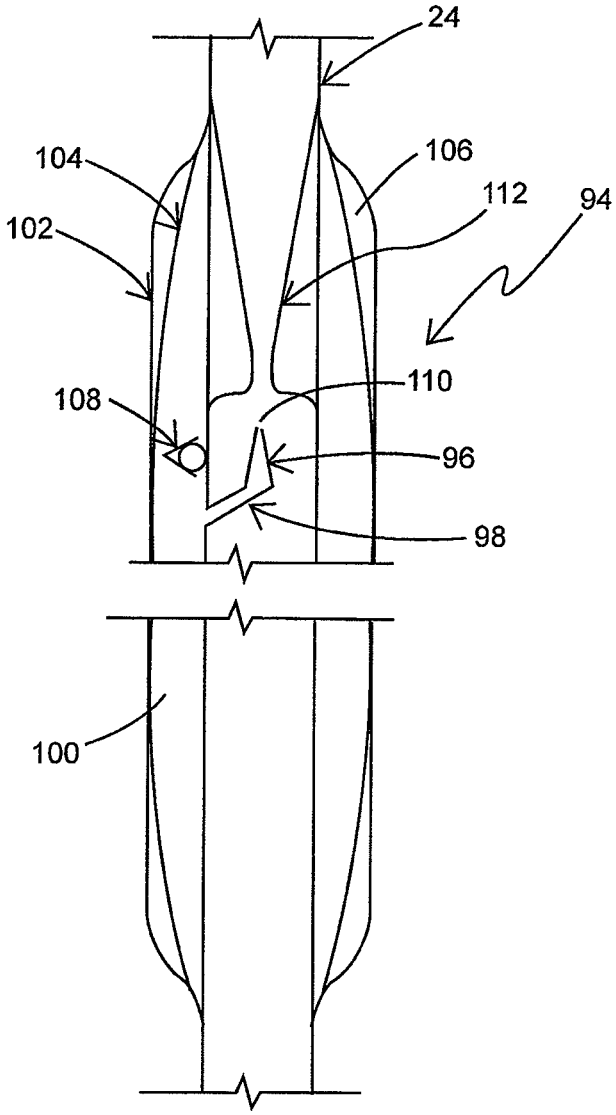
FIG. 4 is a schematic representation of a single-line, hydraulically driven, down-hole jet pressure booster having quick fluid recharge bypass check valve.

FIG. 4 is a schematic representation of a cross section of jet-pump pressure booster, 94, having centralized (longitudinal) jet nozzle, 96, with support tube, 98, in fluid communication with fluid cavity, 100, of accumulator, 102. Annular jets may also be employed, but it is expected that nozzle losses would be higher. Jet-pump pressure booster 94 is similar in operation to jet-pump apparatus 28 shown in FIG. 1B hereof, except that there is no external suction inlet; a single booster 94 may be placed between jet-pump apparatus 28 and the surface, advantageously at about 4,000 feet in the case of an approximately 8,000 foot well. Pressurized fluid from surface pump 14 (FIG. 1 hereof) directed through tube 24 is stored in gas-charged accumulator, 102, having an elastomeric sleeve diaphragm or a pleated metal diaphragm, 104, for separating the gas charge in gas cavity, 106, from the working fluid in fluid cavity 100 during the charging cycle for jet-pump apparatus 28. The charge time for accumulator 102 may be reduced using quick fluid recharge bypass check valve, 108, which permits charging fluid to enter the accumulator without having to pass through restrictive orifice 110 of jet booster nozzle 96. When the charging pressure is released, the pressurized fluid in the jet booster accumulator discharges through the jet booster nozzle into the flow stream from jet-pump apparatus 28, where the momentum of the discharge from the jet booster nozzle adds to and increases the pressure of the fluid stream from the jet pump.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A hydraulically driven jet pumping system for removing fluids from a well bore, comprising in combination:

a surface pump for pumping a chosen fluid;

a tube disposed in said well bore;

a jet-pumping apparatus disposed in said well bore below perforations therein which permit fluid flow between a surrounding formation and said well bore, comprising:

an eductor in fluid communication with said tube and with the fluid flow from the perforations in said well bore;

an inlet check valve for permitting fluid in said well bore to flow into said eductor; and an accumulator comprising a pressure vessel, and a gas-charged metal bellows disposed therein, said accumulator being in fluid communication with said eductor; and a 3-way valve in fluid communication with said surface pump and said tube for exhausting fluids exiting said tube, and for providing fluid communication between said surface pump and said tube.

2. The jet pumping system of claim 1, wherein said chosen fluid comprises produced water.

3. The jet pumping system of claim 1, further comprising means for closing off said accumulator.

4. The jet pumping system of claim 1, further comprising a screen disposed concentric to said tube, between said jet-pumping apparatus and the perforations for removing particles from the fluid flowing through the perforations in said well bore.

5. The jet pumping system of claim 4, further comprising a filter disposed concentric to said screen and said tube for removing particles from the fluid flowing through the perforations in said well bore.

6. The jet pumping system of claim 5, wherein said filter is sealed to said tube and to said jet pumping apparatus.

7. The jet pumping system of claim 5, further comprising a back-flush pressure relief valve disposed between said eductor and the interior of said filter for flushing the filter.

8. The jet pumping system of claim 1, further comprising a fluid bypass valve for permitting fluid from said surface pump for charging said accumulator to bypass said eductor jet.

9. The jet pumping system of claim 1, further comprising a reservoir disposed on the surface for storing exhausted fluids exiting said tube through said 3-way valve.

10. The jet pumping system of claim 1, further comprising one or more hydraulically driven jet-pump pressure boosters at chosen locations along said tube disposed between said jet pumping system and said 3-way valve, for providing additional fluid lift.

11. The jet pumping system of claim 1, wherein said accumulator comprises a three-chamber accumulator for adjusting the pre-charge pressure.

12. A method for removing fluids from a well bore, comprising the steps of:

pumping a chosen fluid from the surface through a tube in the well bore through an eductor disposed in the well bore below the perforations in the well bore and in communication with fluids in the well bore to be removed, and into an accumulator disposed in the well bore until a first selected pressure is obtained;

compressing a gas-charged metal bellows in the accumulator; and releasing the pressure on the tube at the surface, whereby the chosen fluid is forced through the eductor from the accumulator and through the tube to the surface, and fluids in the well bore to be removed are drawn into the eductor and flow into the tube to the surface.

13. The method of claim 12, wherein the chosen fluid comprises produced water.

14. The method of claim 12, further comprising the step of stopping flow of the chosen fluid from the accumulator responsive to a second selected pressure, lower than the first selected pressure.

15. The method of claim 12, further comprising the step of filtering the fluid flowing through the perforations in the well bore using a filter system.

16. The method of claim 12, further comprising the step of back flushing the filter system.

17. The method of claim 12, further comprising the step of bypassing the eductor during said step of pumping a chosen fluid from the surface through a tube in the well bore through the eductor.

18. The method of claim 12, further comprising the step of storing exhausted fluids exiting the tube on the surface.

19. The method of claim 12, further comprising the step of for providing additional fluid lift using one or more hydraulically driven jet-pump pressure boosters at chosen locations along the tube.

20. The method of claim 12, further comprising the step of adjusting the pre-charge pressure in the accumulator.

* * * * *